United States Patent [19]

Graf

[11] 4,368,886

[45] Jan. 18, 1983

[54] INSERTS FOR THE CROSSING POINTS OF TENNIS RACKET STRINGING

[76] Inventor: Roland Graf, Beckmanngasse 38/14, 1150 Wien, Austria

[21] Appl. No.: 283,005

[22] Filed: Jul. 13, 1981

[30] Foreign Application Priority Data

Jul. 18, 1980 [AT] Austria ..... 3746/80

[51] Int. Cl.[3] ..... A63B 51/00

[52] U.S. Cl. ..... 273/73 D

[58] Field of Search ..... 273/73 R, 73 D

[56] References Cited

U.S. PATENT DOCUMENTS 3,921,979 11/1975 Dischinger ..... 273/73 D 4,249,731 2/1981 Amster ..... 273/73 D

FOREIGN PATENT DOCUMENTS 24856 of 1913 United Kingdom ..... 273/73 D

*Primary Examiner*—Richard C. Pinkham

*Assistant Examiner*—Matthew Schneider

*Attorney, Agent, or Firm*—Karl F. Ross

[57] ABSTRACT

A tennis racket in which a handle is provided with a frame of generally oval outline having stringing therein forming arrays of strings running transverse to one another and forming crossing points, with respective inserts being provided at at least some of the crossing points between the strings forming same, the inserts each comprising an absorbent pad impregnated with a liquid lubricant in the form of an oil for reducing friction between the strings at the crossing points, the pads being of sufficiently soft consistency to allow adjacent strings to contact one another through the respective pads at the crossing points.

7 Claims, 3 Drawing Figures

INSERTS FOR THE CROSSING POINTS OF TENNIS RACKET STRINGING

FIELD OF THE INVENTION

The invention relates to inserts for strung tennis rackets, which are to be located at the crossing points of the strings, particularly natural strings, the inserts being formed by a lubricated absorbent material, i.e. felt, leather or similar material of natural or synthetic fibers.

BACKGROUND OF THE INVENTION

From the Austrian Pat. No. 82519 it is known that spacers or inserts may be in the form of leather pieces, which are located between two strings at their crossing point. These leather pieces, however, cannot sufficiently protect the strings against wear, which is caused by mutual friction.

SUMMARY OF THE INVENTION

The invention solves this problem by using an insert, which is impregnated with a liquid lubricant, for example a silicone base oil. Such a lubricant is capable of eliminating the mutual friction at the crossing points of the strings to a large extent, resulting in a considerably longer lifetime of the stringing. It is therefore not required that the inserts prevent the strings from touching; their main function is is to lubricate the contact points between the strings. In one particular embodiment of the invention, the insert is retained in a known crosspiece, preferably of plastic material. Such crosspieces are known in various shapes and have been described in the Austrian Pat. No. 357 072 and the German Pat. No. 2 258 872.

A preferred embodiment of the invention is charcterized by the insert being retained in a crosspiece of known shape in the form of a ring with the axis perpendicular to the plane of the strings, to be inserted between the crossing point of two strings. This ring is preferably formed with diametrically opposed indentations at both ends which are offset from one another and approximately semicircular in cross section and are to engage and retain the two transverse strings.

BRIEF DESCRIPTION OF THE DRAWING

The above and other features and advantages of the invention will become more readily apparent from the following description, reference being made to the accompanying drawing, in which.

SPECIFIC DESCRIPTION

Figure 2:
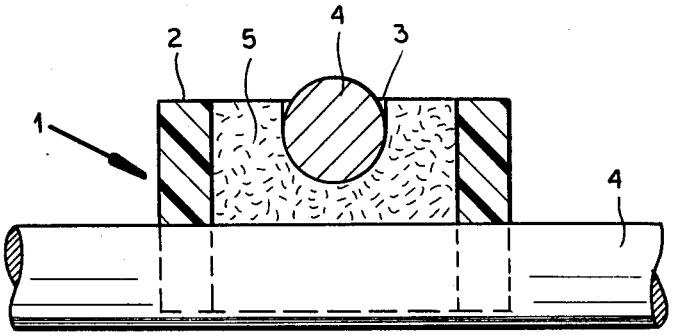
FIG. 2 is an axial sectional view taken along line A—A of FIG. 1.
Figure 1:
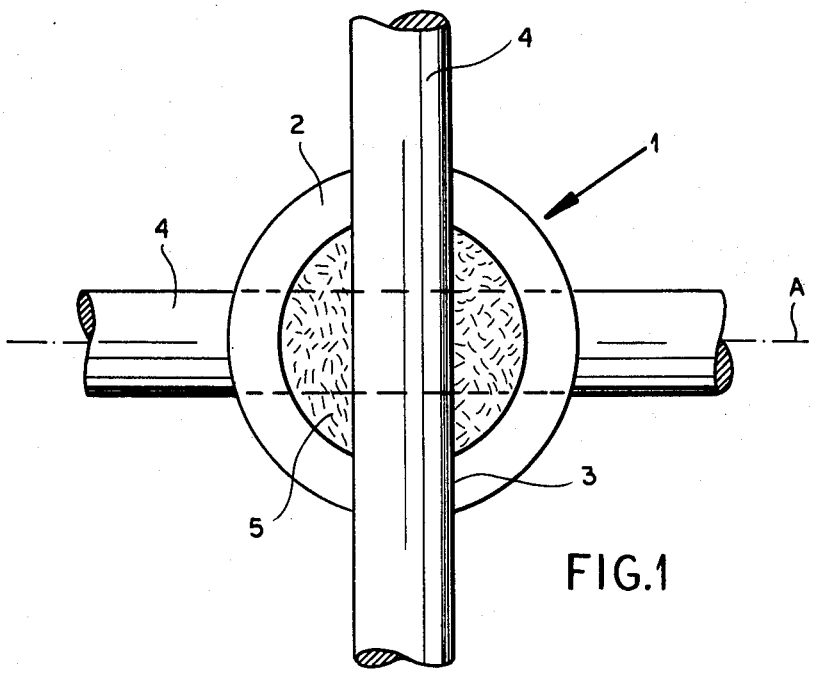
FIG. 1 is a plan view of an insert according to one embodiment of the invention.

The insert 1 has a crosspiece in form of a ring, which has on each end face 2 two approximately semicircular indentations or recesses 3 for the strings 4 of a tennis racket R and retains, as an insert a pad 5 of absorbent material as previously described. The crosspiece is appropriately made of a flexible plastic. As a suitable lubricant to be taken up by the pad 5, a siliconebase oil can be used.

Such a lubricant may also contain an impregnating substance for the material of the strings to further extend their durability. The scope of the invention is not restricted to the form described in the drawings; it is possible, for example, to omit the semicircular indentations 3 in the cross piece, if the plastic material of the ring is sufficiently flexible by itself to be deformed when being inserted between the strings and is thus held in place. Using a suitable material, the insert, impregnated with the lubricant, may be sufficient by itself to be placed between the crossing point of strings without the crosspiece.

Figure 3:
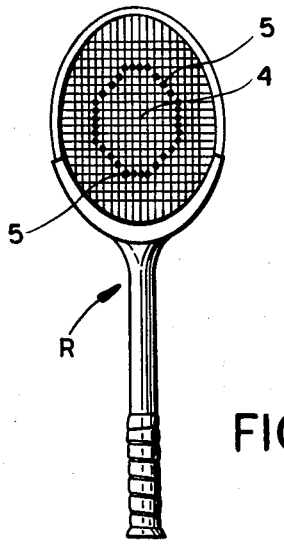
FIG. 3 is an overall view of a tennis racket with inserts according to the invention.

It is not necessary to insert spacers at all crossing points of the strings; in many cases it is sufficient to use the spacers surrounding the area of the sweet spot of the racket as illustrated in FIG. 3.

I claim:

1. A tennis racket comprising:

a handle;

a frame of generally oval outline fixed on said handle;

stringing in said frame including arrays of strings running transverse to one another and forming crossing points; and respective inserts provided at at least some of said crossing points between the strings forming same, said inserts each comprising:

an absorbent pad impregnated with a liquid lubricant in the form of an oil for reducing friction between the strings at said crossing points, said pads being of a sufficiently soft consistency to allow adjacent strings to contact one another through the respective pads at said crossing points.

2. The tennis racket defined in claim 1 wherein said lubricant is a silicone base oil.

3. The tennis racket defined in claim 2 wherein said absorbent material is felt consisting of natural or synthetic fibers.

4. The tennis racket defined in claim 3, further comprising a respective ring surrounding the periphery of each of said pads with the axes of said rings lying perpendicular to the plane of said arrays, each of said rings being further provided with a pair of diametrically opposed indentations formed in opposite ends thereof, each pair of indentations being offset from the other pair, whereby the transverse strings at said respective crossing points can be engaged by said indentations.

5. The tennis racket defined in claim 3, each said insert further comprising a respective ring surrounding the periphery of each of said pads with the axes of said rings lying perpendicular to the plane of said arrays, each of said rings being of a sufficiently soft material whereby the transverse strings at said respective crossing points form indentations in opposite ends of said rings.

6. The tennis racket defined in claim 4 or claim 5 wherein said inserts are provided at only those crossing points whereby an annular pattern surrounding the sweet spot of said tennis racket is formed.

7. A tennis racket comprising:

a handle;

a frame of generally oval outline fixed on said handle;

stringing in said frame including arrays of strings running transverse to one another and forming crossing points; and respective inserts provided at at least some of said crossing points between the strings forming same, said inserts each comprising:

an absorbent pad impregnated with a liquid lubricant in the form of an oil for reducing friction between the strings at said crossing points, and a respective ring surrounding the periphery of each of said pads with the opposite ends of each of said rings being coplanar with the opposite faces of the respective pad thereof and the axes of said rings lying perpendicular to the plane of said arrays, each of said rings being further provided with a pair of diametrically opposed recesses formed in the opposite ends thereof, each pair of respective recesses of a ring being offset from the other pair, said recesses having a depth at least as great as the radius of said strings and adapted to engage same at the respective crossing points thereof, said transverse strings deforming said pads whereby said pads embrace said strings at said respective crossing points over at least half the circumference thereof.

* * * * *